United States Patent [19]

Naser et al.

[11] Patent Number: 4,604,598

[45] Date of Patent: Aug. 5, 1986

[54] ELECTROMAGNETIC RELAY WITH UNDERSLUNG ARMATURE

[75] Inventors: Joachim Naser, Nuremberg; Olaf Schmid, Schwabach; Gerhard Schmidt, Weihenzell; Theodor Sturm, Sachsen; Berthold Walter, Oberasbach, all of Fed. Rep. of Germany

[73] Assignee: Robert Bosch GmbH, Stuttgart, Fed. Rep. of Germany

[21] Appl. No.: 733,527

[22] Filed: May 13, 1985

[30] Foreign Application Priority Data

Jun. 23, 1984 [DE] Fed. Rep. of Germany ..... 3423270

[51] Int. Cl.[4] ..... H01H 67/02

[52] U.S. Cl. ..... 335/128; 335/133; 335/135; 335/203; 335/187

[58] Field of Search ..... 335/128, 133, 135, 202, 335/203, 187, 107; 174/35 TS

[56] References Cited

U.S. PATENT DOCUMENTS 2,872,139 2/1959 Bedford ..... 174/35 TS 3,781,729 12/1973 Hayden ..... 335/203

*Primary Examiner*—Joseph W. Hartary

*Assistant Examiner*—Lincoln D. Donovan

*Attorney, Agent, or Firm*—Frishauf, Holtz, Goodman & Woodward

[57] ABSTRACT

Reduced base plate dimensions are provided for an electromagnetic relay of the kind having a flap type armature by disposing the core which carries a spool and the winding therein perpendicular to the base plate with its free end spaced from the base plate sufficiently for the armature to swing between the free end of the core and the base plate, while being hinged in a seat at one end of the armature provided in the magnet yoke. Support for the magnetic system of the relay, which like the base plate assembly is a preassembled unit is provided by anchoring portions (29) of the magnet yoke which lie against the armature seat and are so set in the base plate when the two subassemblies are put together, that the free end of the core is in the position described. A leaf spring carrying the switch contact as an aperture stamped out in it for centering the armature. The switching path connections are very short and various details are provided to simplify assembly and adjustment of the relay in mass production.

10 Claims, 5 Drawing Figures

ELECTROMAGNETIC RELAY WITH UNDERSLUNG ARMATURE

This invention concerns an electromagnetic relay of the type having a base assembly including a base plate and connection prongs set therein and extending below the base plate and a magnetic system assembly in the form of a preassembled unit including an L-shaped magnet yoke connected to a magnetic core which carries a spool in which a winding is provided, the armature being of the "flap" type mounted at one end so as to swing towards and away from the end of the core.

A known relay of the general kind just described is shown in published German application DE-OS No. 31 48 052 in which the connection prongs set in the base are flat tongues also extending above the base plate serving in part as contact carriers and in part as connection lugs for the winding and/or for the switch contact of the armature.

In the manufacture of this known device, the magnetic system is assembled with the base plate by fastening anchoring projections of the magnet yoke to the base plate. Thereafter, electrical contacts are completed to the connection members of the base plate and the relay is adjusted with respect to contact spacing, contact pressure and reserve for contact erosion. In this relay the core and its winding have their axis running horizontally above the base plate and the flap armature is disposed perpendicular to the base plate at the free end of the core and hinged at one side thereof at the end of the yoke.

This configuration of relay has the disadvantage that the horizontal orientation of the magnet system on the base plate necessarily gives the base plate large dimensions corresponding to the yoke length. The relay accordingly has a large base area and accordingly occupies much area on a panel or chassis on which the relay is mounted by its base plate. There is a further disadvatage that the current path from connection prong to switch contact of the relay runs over the magnet yoke and over the restoring spring for the armature, with the result that when heavy currents are switched an undesired power loss takes place at the relay. When such a relay is used in motor vehicles, in addition to the transfer resistance at the contacts there is an additional voltage drop that is particularly undesirable when the delay is used in electronic circuits.

SUMMARY OF THE INVENTION

It is an object of the present invention to provide an electromagnetic relay of the plug-in type (i.e. with connector members extending downward from the base) in which the current path through the switching contact of the relay is made as short as possible, in which the dimensions of the relay concerning length and width are reduced and for which the cost of manufacture, assembly and adjustment is also reduced.

Briefly, a magnetic system is mounted with the core vertical and its free end facing the base plate. This is done by providing anchoring tongues or prongs extending from the magnet yoke into socket holes in the base plate holding the magnetic system sufficiently above the base plate to permit the armature to make its necessary movements between the free end of the core and the base plate. The anchoring prongs are provided at the same end face of the magnet yoke which is formed so as to provide a seat for the armature.

The relay of the invention has the advantage that the perpendicular disposition of the core above the base plate makes it possible to reduce the critical overall dimensions of the relay practically by half so that on the same surface of a connection plate twice as many relays as before can now be accommodated. There is the further advantage that as a result of the disposition of the armature running parallel to the base plate between the free end of the core and the base plate, the armature lies directly above the connection members of the base plate relating to the switched circuit so that a short Litz conductor is sufficient for connection to the switching contact. As a result, a very short current path for the switching contact of the relay is obtained and consequently a reduced voltage drop and correspondingly smaller power loss.

It is particularly advantageous in the relay of the invention to give the relay a configuration such that assembly and adjustment can be performed by machinery by automatic stations linked sequentially with each other, which means to provide access from the exterior to the necessary parts of the relays for mounting an adjustment for the tools and measuring devices requiring access. For this purpose the base plate is provided with cutouts which leave free for the access of the welding tool at both sides of the connection member of the base plate for the armature in the region where that member is to be welded to the Litz wire. Furthermore, for adjustment of the contact spacing between the switch contact and its working contact when the relay is in its rest or released position, to provide for coining of a projection of the back contact of the relay near at least one side of a hole of the upwardly projecting end of a connection member of the base plate, so that coining tools can have access through the hole to the back contact for this purpose. Furthermore, the basically horizontal disposition of the armature above the base plate makes it possible to provide increased safety against impact, shock and the like by embracing the armature with posts formed on the winding spool for contact making of the switch contact in cooperation with fixed contacts.

BRIEF DESCRIPTION OF THE DRAWINGS

The invention is further described by way of illustrative example with reference to the annexed drawings, in which.

DESCRIPTION OF THE ILLUSTRATED EMBODIMENT

Figure 3:
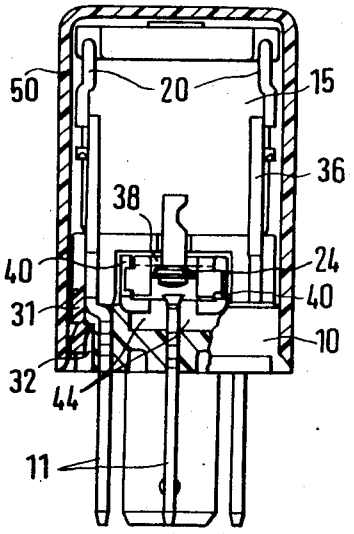
FIG. 3 is a view, partly in section, the relay shown in FIG. 2 rotated 180° with respect to FIG. 2.

Electromagnetic relay shown in FIGS. 1–5 is designed to serve for switching electric appliances on and off in a vehicle, for example, an air conditioner, a heater, a blower, or lights. It consists of a base plate 10 of insulating material in which respective portions of several contact prongs 11 are embedded. A projecting portion of these prongs 11 stands out from the underside of the base plate 10, so that they can be inserted in corresponding mating sockets of a connector, for example, a panel mounted connector, not shown in the drawings.

Figure 4:
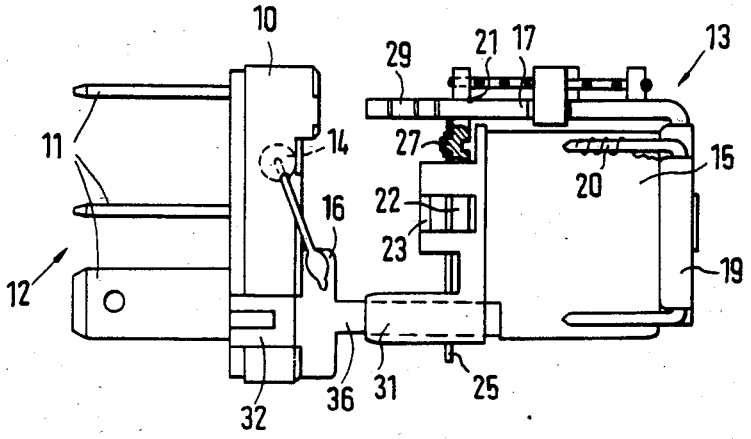
FIG. 4 is a side elevation of the two preassembled subassemblies of the relay of FIGS. 1–3 just prior to their being put together.

As shown in FIG. 4, the relay consists of two preassembled subassemblies, the base group 12 and the magnetic system 13. The base plate 10 with the flat tongue connector prongs 11 and either a resistor or a relaxation bypass diode 14 connected antiparallel to the relay winding 15 between two connector prongs 11 belong to the base group 12. The relaxation bypass diode 14 lies in a recess of the base plate 10 and has a lead coming out of the base plate 10 which is welded to a connection tab 16 of one of the prongs 11.

Figure 1:
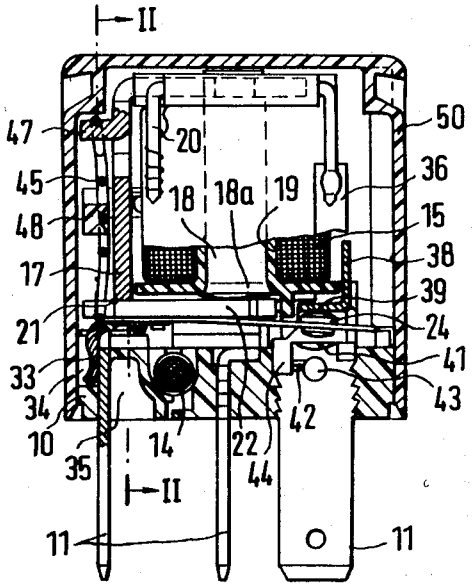
FIG. 1 is a magnified representation in lengthwise section, of an electromagnetic relay in accordance with the invention.

The magnetic system unit 13 consists of an L-shaped magnet yoke 17 having a short bent-over leg, as shown in FIG. 1, to which a winding core 18 is riveted. The core 18 carries a spool 19 in which the relay coil is wound. The coil ends of the relay winding 15 are respectively connected to heavy wires 20 fixed in position on the spool 19.

At the end of the longer leg of the magnet yoke 17, there is a seat 21 for a pivoted "flap" armature 22 which is mounted so as to swing in front of the free end 18*a* of the winding core 18.

In the preassembled condition of the magnetic system unit 13, there are provided, as stop and guide at the front end of the spool 19 for the armature 22, two posts 23 molded at each side of the front end of the spool 19 protruding above the free end 18*a* of the core 18 and constraining on both sides the armature 22 by a hook-like configuration.

The armature 22 carries a switch contact 24 which is riveted to the free end of a leaf spring 25, the other end of which is riveted fast to the armature 22, in the region of the seat 21 of the armature by means of shell riveting 26.

Figure 5:
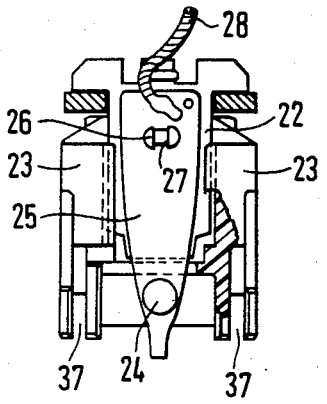
FIG. 5 is an end view of the right-hand subassembly of FIG. 4, as seen from the left, partly in section, illustrating the magnetic system of the relay and providing a view directly onto the pivoted armature.

The fastening of the leaf spring 25 to the "flap" armature 22 is performed by stamping out a rectangular portion of the leaf spring 25 through which a rectangular wart 27 formed out of the armature 22 protrudes, which positions the leaf spring 25 by shell riveting 26 on both sides of the wart 27. The leaf spring 25 is thus fastened to the armature 22 without bowing or restraining forces by these shell rivetings 26. Furthermore, in this way, by virtue of one rivet location 26 in the region of the seat 21 of the armature 22, the spring length of the leaf spring 25 is made as long as possible with reference to the switch contact 24, so that the contact pressure will not vary too greatly when the contact is worn down by spark erosion. In order to obtain bending stress which is as uniform as possible over the entire length of the leaf spring 25, the latter has a width that diminishes parabolically from the riveting location 26 to the switch contact 24. As shown in FIG. 5, the leaf spring 25, at its end riveted fast to the armature 22, is welded to one end of a copper Litz wire 28 for electrical connection of the switch contact 24 to the circuit controlled by the relay.

Two anchoring tongues 29 for insertion into corresponding socket cavities 30 of the base plate 10 are stamped out of the end face of the magnetic yoke 17 which serves as the seat 21 for the armature 22. In order to make provision for fastening the magnetic system assembly 13 on the base assembly 12. In addition, at the front face of the spool 19, two positioning members 31 are molded on which fit into corresponding grooves 32 of the base plate 10 and when inserted there snap into place.

As shown in FIG. 1, the magnetic system 13 is fastened on the base assembly 12 in such a way that the winding core 18 is disposed with its free end 18*a* above the base plate 10, perpendicular to the latter and spaced therefrom. The armature 22 is thus put between the base plate 10 and the lower free end 18 *a* of the core 18 and disposed approximately parallel to the base plate 10. As a result the width of the relay can be reduced nearly all the way down to the diameter of the relay winding 15. Furthermore, by this arrangement of the armature 22, a very short electrical connection to the leaf spring 25 is made possible from its connection tongue 11 which is disposed in the base plate 10 beneath the clamped end of the leaf spring 25.

It is thus possible, as shown in FIG. 5, to limit the length of the copper Litz wire 28 welded onto the leaf spring 25 to a few millimeters and to weld the other end of the Litz wire 28, as shown in FIG. 1 to the upper end of the corresponding connector tongue 11. For accessibility of a welding tool, the base plate 10 is provided with cutouts 34 and 35 on both of its sides in the region of the weld location 33.

When the magnetic system 13 is put on to the base assembly 12 as shown in FIG. 4, two upwardly projecting connection lugs 36 at the upper side of the base plate 10 extend into guides 37 of the spool 19 until they lie under the respective ends of the two heavy wires 20 for the necessary connection of the relay winding 15. The lugs 36 are welded to the heavy wires 20 in a further assembly station after the two subassemblies have been put together.

For adjustment of the relay the respective positions of the switch contact 24 in operated and released conditions of the armature 22 are measured and thereafter a contact carrier 38 of U-shaped configuration which provides the working contact 39 of the relay in its mid region is set into the relay. The two lateral legs of the contact carrier 38 are then welded onto two connection lugs 40 above the base plate 10, the lugs 40 being integral with the middle connection tongue 11 and bent up on both sides of the contact carrier 38. The switch contact 24 also cooperates with a rest contact 41 which is provided by the upwardly protruding end of a corresponding connector prong 11. The spacing of the switch contact 24 from the working contact 39 in the released condition of the relay is set by the position of the rest contact 41. This adjustment is produced as FIG. 1 shows by a coining 42 of the rest contact 41 by which the rest contact 41 is raised on one side of a hole 43 stamped into the upper end of the flat connection prong 11. Here, also, it is assured, by a corresponding cavity 44 in the base plate 11, that suitable coining tools can be brought by machinery to the hole 43.

In order to hold the armature 22 in a definite rest position when the relay is switched on, an armature return spring 45 bent into meander shape is provided behind the armature seat 21, having one end suspended on a stamped out tongue 46 of the armature 22 and the other end hung on another stamped out and bent out tongue 47 of the magnetic yoke 17. The armature return spring 45 moreover, is bowed towards the magnetic yoke 17 by means of a spring clip 48 of resilient plastic in order to oppose axial shift of the armature 22 at its seat 21. The clip 48 is clipped on to the yoke 17 by its hooked ends and is there constrained by by grooves 49.

Figure 2:
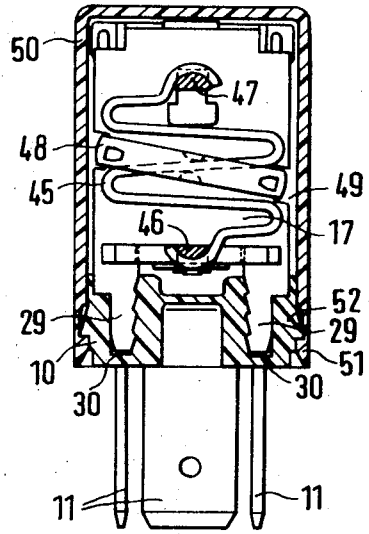
FIG. 2 is a section in the plane indicated by the line 2—2 in FIG. 1.

After the assembly and adjustment of the relay by a suitable production line of automatic machines, the plastic casing 50 is pushed over the magnetic system assembly 13 in a final work operation until the bottom edge 51 of the casing catches behind corresponding projections 52 at the lengthwise running edges of the base plate 10, as shown in FIG. 2.

Although the invention has been described with reference to a particular illustrative embodiment, it will be recognized that variations and modifications are possible within the inventive concept.

We claim:

1. Electromagnetic relay comprising a base plate of insulating material in which are anchored connection prongs extending therebeneath, a preassembled magnetic system including an L-shaped magnet yoke, a winding core, a spool carried by said core, a winding on said spool, and a flap-type armature swingably mounted at a first end thereof on said magnet yoke; at least one switch contact mounted on said armature at a second end thereof opposite said first end, at least one contact fixed on said base plate for cooperation with said at least one switch contact, said preassembled magnetic system being fastened to said base plate by stamped out anchoring portions of said magnet yoke, and further comprising;

a seat (21) for said armature (22) formed on an end face of said magnet yoke (17) for seating said armature, in a manner suitable for testing said preassembled magnetic system, in a location which is defined on said magnetic yoke (17) without regard to whether said yoke is anchored on said base plate (10), said anchoring portions (29) of said magnet yoke (17) being located adjacent said armature seat (21) and so set in corresponding cavities (30) in said base plate (10) that said core (18) carrying said spool (19) is disposed perpendicularly to, above, and spaced from said base plate, and so that said armature (22) is seated so as to be between said base plate (10) and a free end (18*a*) of said core directed towards said base plate (10).

2. Relay according to claim 1, wherein said spool (19) is of a configuration providing, integral therewith, two lateral posts (23) protruding beyond said free end (18*a*) of said core (18) and embracing in hook shape said armature (22) at both sides thereof for serving as a positioning stop therefor.

3. Relay according to claim 1, in which a leaf spring (25) is fastened to said armature (22) by shell riveting (26) in the region of the seat (21) of said armature and said switch contact (24) is mounted at the end of said leaf spring remote from said end riveted to said armature, the end of said leaf spring at which said switch contact is mounted being the free end thereof.

4. Relay according to claim 3, in which said leaf spring (25) has a width which tapers down parabolically from the neighborhood of said shell riveting (26) to the neighborhood of said switch contact (24).

5. Relay according to claim 4, in which said leaf spring has a transversely disposed elongated aperture and said armature (22) has a correspondingly elongated protruding wart (27) in its configuration which is so located as to protrude through said aperture of said leaf spring, and in which said shell riveting of said leaf spring to said armature is provided by a shell rivet (26) at each of the two narrow sides of said wart.

6. Relay according to claim 3, in which a Litz wire connection (28) is welded at one end to said leafed spring at the end of said leaf spring which is riveted to said armature, the other end of said Litz wire being welded to a connection member (11) held in said base plate (10).

7. Relay according to claim 6, in which said base plate is provided with cutouts (34, 35) providing access on both sides of said connection member (11) in the region of the place of welding said Litz wire thereto, for access of a welding tool.

8. Relay according to claim 1, in which at least one contact fixed on said base plate is a working contact (39) forming a part of a contact carrier (38) welded on a connection member (11) anchored in said base plate (10) at a welding location above said base plate (10).

9. Relay according to claim 8, in which a rest contact (41) for said switch contact (24) is provided which is formed by an upwardly protruding end of a connection member (11) set in said base plate which also has a downwardly protruding end.

10. Relay according to claim 9, in which said rest contact (41) is provided with a coined deformation (42) on at least one side of a hole (43) in said upwardly protruding end of said connection (11) set in said base plate for adjustment of the spacing of said switch contact (24) of said relay from said at least one contact fixed on said base plate during the period in which said relay is in its rest position.

* * * * *